United States Patent [19]

Takahashi

[11] Patent Number: 4,718,384

[45] Date of Patent: Jan. 12, 1988

[54] FUEL INJECTOR FOR USE IN AN INTERNAL COMBUSTION ENGINE

[75] Inventor: Takeshi Takahashi, Mishima, Japan

[73] Assignee: Toyota Jidosha Kabushiki Kaisha, Aichi, Japan

[21] Appl. No.: 863,424

[22] Filed: May 15, 1986

[30] Foreign Application Priority Data

May 29, 1985 [JP] Japan ..... 60-113993

[51] Int. Cl.[4] ..... F02M 39/00

[52] U.S. Cl. ..... 123/447; 123/496; 123/300; 123/506

[58] Field of Search ..... 123/447, 496, 506, 300, 123/299, 446

[56] References Cited

U.S. PATENT DOCUMENTS

| | | | |
|---|---|---|---|
| 4,129,253 | 12/1978 | Bader, Jr. et al. | 123/506 |
| 4,211,203 | 7/1980 | Kobayashi | 123/506 |
| 4,271,805 | 6/1981 | Kobayashi | 123/506 |
| 4,271,808 | 6/1981 | Kobayashi | 123/506 |
| 4,535,742 | 2/1985 | Laufer | 123/447 |
| 4,590,903 | 5/1986 | Hofman | 123/447 |
| 4,612,893 | 9/1986 | Ishibashi | 123/496 |

FOREIGN PATENT DOCUMENTS 56-31655 3/1981 Japan .

*Primary Examiner*—Carl Stuart Miller
*Attorney, Agent, or Firm*—Parkhurst & Oliff

[57] ABSTRACT

A fuel injector having therein a pressure chamber connected to a nozzle bore. Fuel in the pressure chamber is pressurized by a plunger driven by an engine and is injected from the nozzle bore when the pressure in the pressure chamber exceeds a predetermined pressure. The volume of the pressure chamber is controlled by a piston device actuated by low pressure. The movement of the piston device prevents the injection of fuel. The injection of fuel is stopped by causing the piston device to move relatively freely.

16 Claims, 5 Drawing Figures

FUEL INJECTOR FOR USE IN AN INTERNAL COMBUSTION ENGINE

BACKGROUND OF THE INVENTION

1. Field of the Invention

The present invention relates to a fuel injector for use in an internal combustion engine.

2. Description of the Related Art

A fuel injector equipped therein with a pressure chamber connected to nozzle bores via an automatically opened needle is known. In this fuel injector, fuel fed into the pressure chamber is pressurized by a pressurizing device, for example, by a plunger, and then the fuel thus pressurized is injected from the nozzle bores. Such a fuel injector is normally called a unit fuel injector. A unit fuel injector has a high efficiency, and thus unit fuel injectors of various types have been developed. For example, in order to precisely control the fuel injection, a unit fuel injector using a solenoid valve is known (Japanese Unexamined Utility Model publication No. 56-31655). In this unit injector, a solenoid valve is arranged in a fuel discharge passage connected to the pressure chamber. When the fuel injection is carried out, the fuel discharge passage is closed by the solenoid valve to isolate the pressure chamber from the outside. As a result, since the fuel in the pressure chamber is pressurized when the plunger is caused to move towards the pressure chamber, fuel is injected from the nozzle bores. Contrary to this, when the fuel injection is stopped, the solenoid valve opens the fuel discharge passage so that the fuel pressurized by the plunger is discharged from the pressure chamber via the fuel discharge passage.

As mentioned above, in this unit fuel injector, when the fuel injection is carried out, the fuel discharge passage is closed by the solenoid valve. However, at this time, the pressure in the pressure chamber becomes considerably high. Consequently, a high pressure acts on the solenoid valve, and thus there occurs a problem in that a large and strong solenoid valve will be necessary. In addition, if such a large and strong solenoid valve is used, when the solenoid valve is deenergized, a strong residual magnetism remains in the solenoid. As a result, since the solenoid valve does not operate as soon as the solenoid is deenergized, another problem occurs in that a good responsiveness of the solenoid valve can not be obtained. Furthermore, as mentioned above, where the injection of fuel is started by stopping the flow of the pressurized fuel flowing within the fuel discharge passage, and where the injection of fuel is stopped by starting the flow of the pressurized fuel, a certain time must elapse before the flow of the pressurized fuel is started or completely stopped after the solenoid is energized or deenergized. Therefore, a further problem occurs in that the start and stop of the fuel injection will be delayed.

SUMMARY OF THE INVENTION

An object of the present invention is to provide a fuel injector capable of controlling the fuel injection by means of a small solenoid valve and improving the responsiveness of the start and stop of the fuel injection.

According to the present invention, there is provided a fuel injector of an internal combustion engine, comprising: an injector body forming a pressure chamber therein; a spring loaded needle for controlling the opening operation of a nozzle bore to automatically open the nozzle bore and inject fuel in the pressure chamber from the nozzle bore when pressure in the pressure chamber exceeds a predetermined pressure; pressurizing means for pressurizing the fuel in the pressure chamber; and volume control means controlling the volume of the pressure chamber and controlled by a liquid pressure which is lower than the pressure generated in the pressure chamber when the injection of fuel is carried out, the volume control means increasing the volume to stop the injection of fuel.

The present invention may be more fully understood from the description of preferred embodiments of the invention set forth below, together with the accompanying drawings.

DESCRIPTION OF PREFERRED EMBODIMENTS

Figure 1:
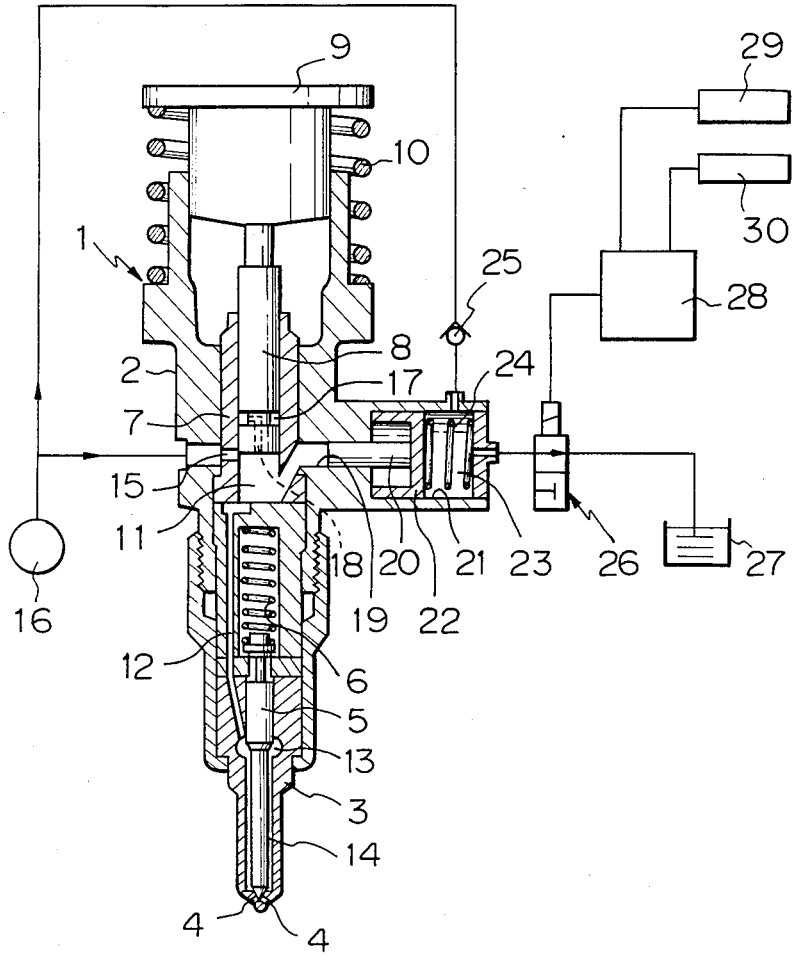
FIG. 1 is a cross-sectional side view of an embodiment of a fuel injector according to the present invention.

Referring to FIG. 1, reference numeral 1 designates a fuel injector for use in a diesel engine, 2 an injector body, 3 a needle holder mounted on the lower end of the injector body 2, and 4 nozzle bores formed on the tip of the needle holder 3; 5 designates a needle normally closing the nozzle bores 4 due to the spring force of a compression spring 6, 7 a plunger barrel fitted into the injector body 2, 8 a plunger slidably inserted into the plunger barrel, and 9 a tappet slidably inserted into the injector body 2 to actuate the plunger 8; 10 designates a compression spring for biasing the tappet 9 upward. The tappet 9 is caused to move up and down by means of a rocker arm or a cam (not shown) which is driven by the engine, and the plunger 8 is also caused to move up and down by means of the tappet 9. A pressure chamber 11 defined by the plunger 8 is formed in the plunger barrel 7 and connected to the nozzle bores 4 via a fuel passage 12, a nozzle chamber 13, and an annular fuel passage 14 formed around the needle 5 when the needle 5 opens the nozzle bores 4. The barrel 7 forms therein a fuel feed port 15 which is able to be open to the pressure chamber 11. The opening operation of the fuel feed port 15 is controlled by the plunger 8. The fuel feed port 15 is connected to a fuel feed pump 16 discharging a relatively low pressure fuel. An annular groove 17 is formed on the outer circumferential wall of the lower portion of the plunger 8, and a connecting bore 18 interconnecting the annular groove 17 to the pressure chamber 11 is formed in the lower end of the plunger 8.

When the plunger 8 moves downward and closes the fuel feed port 15, fuel in the pressure chamber 11 is pressurized by means of the plunger 8. Consequently, the plunger 8 forms a pressurizing device for pressurizing the fuel in the pressure chamber 11. When the pressure in the pressure chamber 11 exceeds a predetermined high pressure, that is, when the pressure in the nozzle chamber 13 exceeds a predetermined high pressure, the needle 5 moves upward against the compression spring 6, and thus the injection of fuel from the nozzle bores 4 is started. After this, when the needle 8 further moves downward, and the fuel feed port 15 opens to the annular groove 17 of the plunger 8, the pressurized fuel in the pressure chamber 11 is returned to the fuel feed port 15 via the connecting bore 18 and the annular groove 17, and thus the injection of fuel is stopped. The above-mentioned injecting operation of the fuel injector 1 is a basic injecting operation in the case where the control of the fuel injection is not carried out.

The injection control device for controlling the injecting timing will be hereinafter described.

Referring to FIG. 1, a cylindrical bore 19 continuously connected to the pressure chamber 11 is formed in the injector body 2, and a plunger 20 for controlling the injection timing is slidably inserted into the cylindrical bore 19. In addition, a cylinder 21 having a diameter which is larger than that of the cylindrical bore 19 is formed in the injector body 2 at a position adjacent to the cylindrical bore 19, and a piston 22 having a diameter which is larger than that of the plunger 20 is slidably inserted into the cylinder 21. The outer end of the plunger 20 abuts against the piston 22. A cylinder chamber 23 defined by the piston 22 is formed in the cylinder 21, and a compression spring 24 for biasing the piston 22 is arranged in the cylinder chamber 23. The spring force of the compression spring 24 is determined so that the force acting on the piston 22 by means of the compression spring 24 is weaker than the force acting on the needle 5 when the needle 5 opens the nozzle bores 4. The cylinder chamber 23 is connected, on one hand, to the fuel feed pump 16 via a check valve 25 which permits only the inflow of fuel into the cylinder chamber 23 from the fuel feed pump 16 and, on the other hand, to a fuel tank 27 via a solenoid valve 26. The solenoid valve 26 is connected to an electronic control unit 28, and, for example, a sensor 29 detecting the depression of the accelerator pedal and an engine speed sensor 30 are connected to the electronic control unit 28. The solenoid valve 26 is controlled by the output signal of the electronic control unit 28 in response to the engine speed and the depression of the accelerator pedal.

Figure 2:
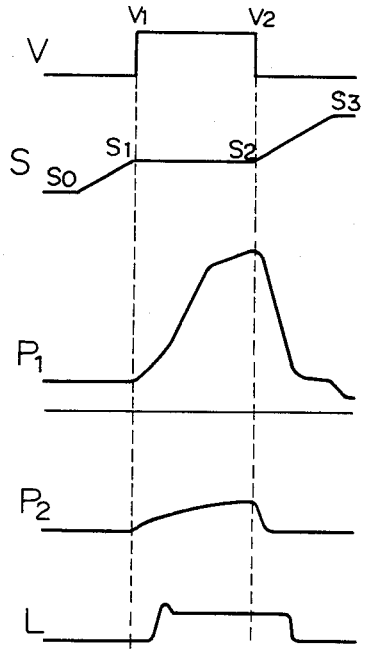
FIG. 2 is a diagram illustrating the movement of the plunger, the pressure of fuel and the lift of the needle.

The injection control method will be hereinafter described with reference to FIGS. 1 and 2.

When the solenoid valve 26 is positioned at a position wherein the cylinder chamber 23 is connected to the fuel tank 27 as illustrated in FIG. 1, the fuel fed into the cylinder chamber 23 from the fuel feed pump 16 is discharged into the fuel tank 27 via the solenoid valve 26. At this time, the pressure in the cylinder chamber 23 is approximately equal to the atmospheric pressure. Consequently, the plunger 8 moves downward and closes the fuel feed port 15 and, after this, when the plunger 8 moves further downward, since the pressure in the cylinder chamber 23 is approximately equal to the atmospheric pressure, the plunger 20 moves towards the right in FIG. 1 together with the piston 22 against the compression spring 24. Therefore, at this time, the fuel in the pressure chamber 11 is slightly pressurized. The moving distance of the plunger 20 at this time is illustrated by $S_0$ to $S_1$ in FIG. 2. In FIG. 2, $P_1$ indicates the pressure of fuel in the pressure chamber 11; $P_2$ indicates the pressure of fuel in the cylinder chamber 23; and L indicates the lift of the needle 5. After this, when the solenoid valve 26 is energized at $V_1$ in FIG. 2, the solenoid valve 26 disconnects the cylinder chamber 23 from the fuel tank 27. As a result, the pressure in the cylinder chamber 23 instantaneously increases to the discharge pressure of the fuel feed pump 16. If the pressure in the cylinder chamber 23 increases, a great pressure (=the pressure in the cylinder chamber 23×the cross-sectional area of the piston 22/the cross-sectional area of the plunger 20) acts on the plunger 20. Consequently, at this time, even if the pressure in the pressure chamber 11 becomes considerably high, the plunger 20 remains almost stationary. Therefore, when the plunger 8 moves downward after the solenoid valve 26 is energized, the plunger 20 remains almost stationary as illustrated by $S_1$ to $S_2$ in FIG. 2, and the pressure in the pressure chamber 11 rapidly increases as illustrated by $P_1$ in FIG. 2. At this time, as illustrated by $P_2$ in FIG. 2, the pressure in the cylinder chamber 23 slightly increases in accordance with a rapid increase in the pressure in the pressure chamber 11. When the pressure in the pressure chamber 11 exceeds a predetermined pressure, the needle 5 moves upward as mentioned above, and thus the injection of fuel is started. After this, when the solenoid valve 26 is deenergized at $V_2$ in FIG. 2, the cylinder chamber 23 is connected to the fuel tank 27, and thus the pressure in the cylinder chamber 23 decreases. As a result, since the plunger 20 moves towards the right in FIG. 1 as illustrated by $S_2$ to $S_3$ in FIG. 2, the pressure in the pressure chamber 11 decreases, and thus the injection of fuel is stopped. After this, when the annular groove 17 of the plunger 8 is connected to the fuel feed port 15, the pressure in the pressure chamber 11 further decreases, and thus the plunger 20 is returned to the initial position.

Figure 3:
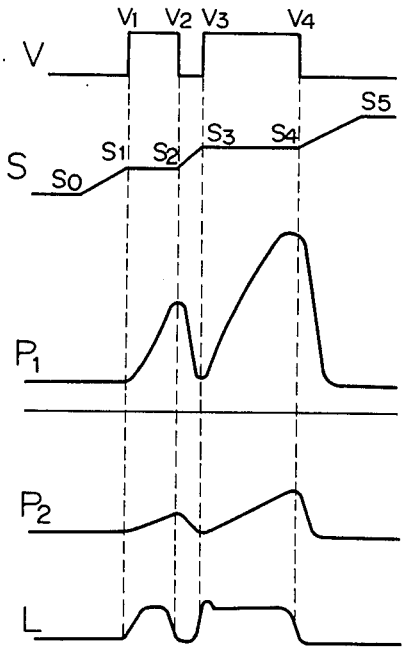
FIG. 3 is a diagram also illustrating the movement of the plunger, the pressure of fuel and the lift of the needle.

FIG. 3 illustrates the case where the solenoid valve 26 is energized during the time $V_1$ to $V_2$ in order to carry out a pilot injection, and then the solenoid valve 26 is energized again during the time $V_3$ to $V_4$ in order to carry out a main injection. In the present invention, the responsiness of the operation of the solenoid valve 26 and the responsiveness of an increase and a reduction in pressure of the pressure chamber 11 to the operation of the solenoid valve 26 are improved, and thus the two stage injections illustrated in FIG. 3 can be precisely and easily carried out.

Figure 4:
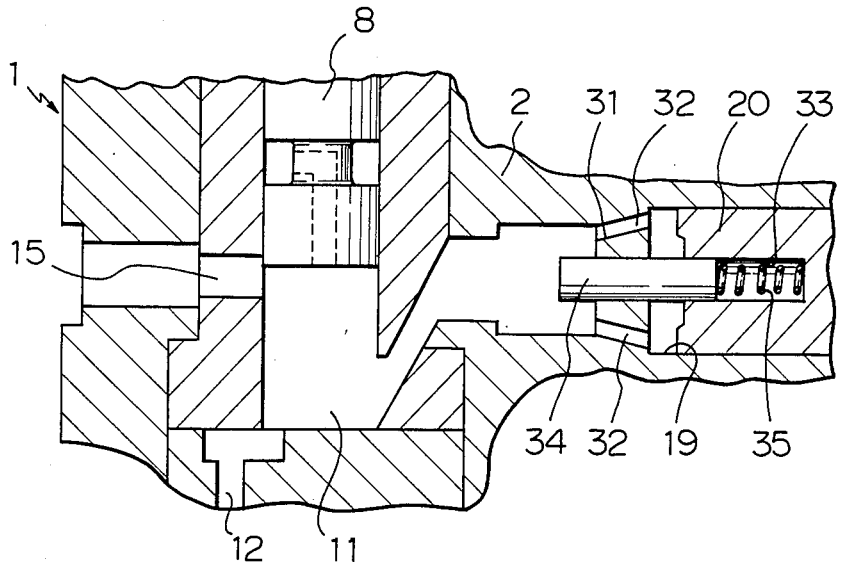
FIG. 4 is an enlarged cross-sectional side view of a portion of another embodiment of a fuel injector according to the present invention.
Figure 5:
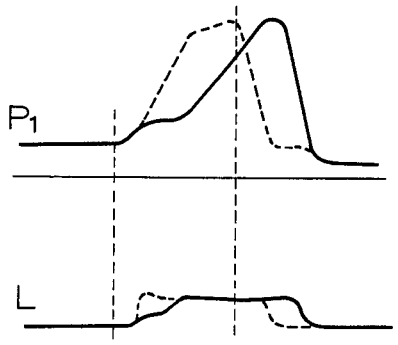
FIG. 5 is a diagram illustrating the pressure of fuel and the lift of needle in the embodiment illustrated in FIG. 4.

FIG. 4 illustrates another embodiment. In this embodiment, a separating wall 31 is formed between the pressure chamber 11 and the cylindrical bore 19 into which the plunger 20 is slidably inserted, and fuel passages 32 interconnecting the pressure chamber 11 and the interior of the cylindrical bore 19 are formed in the separating wall 31. In addition, a small cylindrical bore 33 is formed on the inner end face of the plunger 20, and an auxiliary plunger 34 is slidably inserted into the small cylindrical bore 33. This auxiliary plunger 34 extends through the separating wall 31. A compression spring 35 is inserted into the small cylindrical bore 33, and the spring force of the compression spring 35 is determined so that the force acting on the auxiliary plunger 34 by means of the compression spring 35 is slightly larger than the force acting on the needle 5 when the needle 5 opens the nozzle bores 4. Consequently, in this embodiment, when the pressure in the pressure chamber 11 exceeds a predetermined pressure, the injection of fuel is started. After this, when the pressure in the pressure chamber 11 further increases, since the auxiliary plunger 34 is retracted, the amount of fuel injected at the initial stage of the injecting operation is reduced as illustrated by the solid line in FIG. 5.

According to the present invention, the pressure in the cylinder chamber 23 is controlled by the solenoid valve 26. However, since the pressure in the cylinder chamber 23 is low, a small size solenoid valve can be used as the solenoid valve 26. Therefore, there are advantages in that power consumption is minimized, and that the solenoid valve 26 can be easily arranged within a narrow space of the top face of the cylinder head. In addition, since the size of the solenoid valve 26 is small, when the solenoid valve 26 is deenergized, the residual magnetism does not remain in the solenoid. As a result, since the solenoid valve 26 is operated instantaneously when the solenoid valve 26 is deenergized, a good responsiveness of the solenoid valve 26 can be obtained. Furthermore, since the pressurizing operation of the pressure chamber 11 is started by merely stopping the movement of the plunger 20, it is possible to improve the responsiveness of the opening operation of the needle 5.

While the invention has been described by reference to specific embodiments chosen for purposes of illustration, it should be apparent that numerous modifications could be made thereto by those skilled in the art without departing from the basic concept and scope of the invention.

I claim:

1. A fuel injector of an internal combustion engine, comprising:

an injector body forming a pressure chamber therein;

a spring loaded needle for controlling the opening operation of a nozzle bore to automatically open said nozzle bore and inject fuel in said pressure chamber from said nozzle bore when pressure in said pressure chamber exceeds a predetermined pressure;

pressurizing means for pressurizing the fuel in said pressure chamber; and volume control means for controlling a volume of said pressure chamber and controlled by liquid pressure which is lower than the pressure generated in said pressure chamber when the injection of fuel is carried out, said volume control means increasing said volume to stop the injection of fuel;

said volume control means comprising a cylinder, a piston device movable in said cylinder to control said volume, a cylinder chamber defined by said piston device and filled with liquid generating said liquid pressure, and a control device controlling said liquid pressure to reduce said liquid pressure for increasing said volume.

2. A fuel injector according to claim 1, wherein said pressurizing means comprises a plunger slidably inserted into said injector body and driven by said engine, said plunger defining a wall portion of said pressure chamber.

3. A fuel injector according to claim 2, wherein said injector body comprises a fuel feed port alternately covered and uncovered by said plunger, said plunger having an annular groove formed on an outer circumferential wall of said plunger and connected to said pressure chamber, said fuel feed port being open directly to said pressure chamber when said plunger maximizes said volume, said fuel feed port being open to said annular groove when said plunger minimizes said volume.

4. A fuel injector according to claim 1, wherein said injector body has a cylindrical bore formed therein and is continuously connected to said pressure chamber, and said piston device comprises a piston movable in said cylinder, and a plunger movable in said cylindrical bore and connected to said piston, said plunger having a diameter which is smaller than that of said piston.

5. A fuel injector according to claim 4, wherein said plunger has a small bore formed on an inner end face thereof and has an auxiliary plunger slidably inserted into said small bore, a compression spring being arranged in said small bore to bias said auxiliary plunger.

6. A fuel injector according to claim 5, wherein a separating wall is formed between said pressure chamber and said cylindrical bore and has a fuel passage extending therethrough, said auxiliary plunger extending through said separating wall.

7. A fuel injector according to claim 5, wherein the spring force acting on said auxiliary plunger by means of said compression spring is slightly larger than the force acting on said needle when said needle opens said nozzle bore.

8. A fuel injector according to claim 1, wherein a compression spring is arranged in said cylinder chamber to bias said piston, and the force acting on said piston by means of said compression spring is smaller than the force acting on said needle when said needle opens said nozzle bore.

9. A fuel injector according to claim 1, wherein said control device comprises a pressurized liquid source, a check valve arranged between said pressurized liquid source and said cylinder chamber and permitting only the inflow of liquid into said cylinder chamber from said pressurized liquid source, and a solenoid valve controlling the outflow of liquid from said cylinder chamber, said solenoid valve permitting the outflow of liquid from said cylinder chamber to stop the injection of fuel and stopping the outflow of liquid from said cylinder chamber to carry out the injection of fuel.

10. A fuel injector according to claim 9, wherein said liquid is fuel and said liquid source is a fuel feed pump which is used for feeding fuel into said pressure chamber.

11. A fuel injector of an internal combustion engine, comprising:

an injector body forming a pressure chamber therein;

a spring loaded needle for controlling the opening operation of a nozzle bore to automatically open said nozzle bore and inject fuel in said pressure chamber from said nozzle bore when pressure in said pressure chamber exceeds a predetermined pressure;

pressurizing means for pressurizing the fuel in said pressure chamber; and volume control means for controlling a volume of said pressure chamber, said volume control means comprising a surface portion defining a wall portion of said pressure chamber, said surface portion adapted to take a volume limiting position when the injection of fuel is carried out, said surface portion being retractable to a volume increasing position to stop the injection of fuel.

12. A fuel injector according to claim 11, wherein said pressurizing means comprises a plunger slidably inserted into said injector body and driven by said engine, said plunger defining a second wall portion of said pressure chamber.

13. A fuel injector according to claim 12, wherein said injector body comprises a fuel feed port alternately covered and uncovered by said plunger, said plunger having an annular groove formed on an outer circumferential wall of said plunger and connected to said pressure chamber, said fuel feed port being open directly to said pressure chamber when said plunger maximizes said volume, said fuel feed port being open to said annular groove when said plunger minimizes said volume.

14. A fuel injector of an internal combustion engine, comprising:

an injector body forming a pressure chamber therein;

a spring loaded needle for controlling the opening operation of a nozzle bore to automatically open said nozzle bore and inject fuel in said pressure chamber from said nozzle bore when pressure in said pressure chamber exceeds a predetermined pressure;

pressurizing means for pressurizing the fuel in said pressure chamber; and volume control means for controlling a volume of said pressure chamber and controlled by liquid pressure which is lower than the pressure generated in said pressure chamber when the injection of fuel is carried out, wherein said liquid pressure bears on a first surface portion of said volume control means and said pressure in said pressure chamber bears on a second surface portion of said volume control means in opposition to said liquid pressure, said volume control means being controllable to increase said volume to stop the injection of fuel.

15. A fuel injector according to claim 14, wherein said pressurizing means comprises a plunger slidably inserted into said injector body and driven by said engine, said plunger defining a wall portion of said pressure chamber.

16. A fuel injector according to claim 15, wherein said injector body comprises a fuel feed port alternately covered and uncovered by said plunger, said plunger having an annular groove formed on an outer circumferential wall of said plunger and connected to said pressure chamber, said fuel feed port being open directly to said pressure chamber when said plunger maximizes said volume, said fuel feed port being open to said annular groove when said plunger minimizes said volume.

* * * * *